US005582579A

United States Patent [19]

Chism et al.

[11] Patent Number: 5,582,579

[45] Date of Patent: Dec. 10, 1996

[54] ORTHOPEDIC THERAPY AND REHABILITATION DEVICE

[76] Inventors: Jeffrey K. Chism, 7601 E. Treasure Dr., #1605, North Bay Village, Fla. 33141; Dudley K. Chism, 106 Quail Hollow Ct., Naples, Fla. 33962

[21] Appl. No.: 348,375

[22] Filed: Dec. 1, 1994

[51] Int. Cl.[6] ..... A61H 1/00

[52] U.S. Cl. ..... 601/27; 601/34; 602/36; 482/79

[58] Field of Search ..... 482/79, 91, 95, 482/124, 125, 131, 907; 601/27, 33, 34, 35; 602/32, 36

[56] References Cited

U.S. PATENT DOCUMENTS

| | | | |
|---|---|---|---|
| 324,498 | 8/1885 | Surbaugh . | |
| 1,240,809 | 9/1917 | Baldwin . | |
| 1,606,792 | 11/1926 | Simmons . | |
| 1,618,273 | 2/1927 | Davidson | 482/124 |
| 2,160,722 | 5/1939 | Cunningham . | |
| 2,214,052 | 9/1940 | Good | 482/79 |
| 2,716,027 | 2/1953 | Gehri . | |
| 2,845,063 | 1/1957 | Allen . | |
| 2,865,108 | 10/1958 | King . | |
| 3,256,015 | 6/1966 | Perrin . | |
| 3,655,185 | 4/1972 | Kane | 601/35 |
| 3,905,135 | 9/1975 | Debusk . | |
| 4,229,001 | 10/1980 | Roman . | |
| 4,251,070 | 2/1981 | Leseberg . | |
| 4,325,548 | 4/1982 | Piccini . | |
| 4,444,389 | 4/1984 | Wruckle | 482/79 |
| 4,552,356 | 11/1985 | Brousseau . | |
| 4,596,387 | 6/1986 | Roberts . | |
| 4,728,103 | 3/1988 | Fulton . | |
| 4,846,461 | 7/1989 | Robards, Jr. et al. . | |
| 4,909,505 | 3/1990 | Tee . | |
| 4,940,066 | 7/1990 | Santilli et al. | 482/907 |
| 4,998,722 | 3/1991 | Scott . | |
| 5,004,228 | 4/1991 | Powers . | |
| 5,127,892 | 7/1992 | Sawdon | 482/79 |
| 5,277,680 | 1/1994 | Johnston | 482/907 |

FOREIGN PATENT DOCUMENTS

| | | | |
|---|---|---|---|
| 2696942 | 4/1994 | France | 601/27 |

*Primary Examiner*—Lynne A. Reichard
*Assistant Examiner*—Jeanne M. Clark

[57] ABSTRACT

There is provided an orthopedic device for therapy and rehabilitation of knee joints and the like which includes a flexible wraparound style boot which substantially supports a user's foot and ankle. The boot includes an interior for receiving the user's foot, heel and toe portions, and a substantially open front portion for easy insertion and withdrawal of a user's foot. An adjustable closure spans across the open front portion to help conform the boot to the user's foot without unnecessary binding, and a pair of manipulation straps extend from opposite sides of the toe portion of the boot adjacent the substantially open portion. A pair of grasping handles are attached to respective manipulation straps to provide exercise and flexion control by the patient. The device insures proper line of pull and anatomically correct splay. In a preferred embodiment, the flexion straps are adjustable in length adjacent the handles to facilitate adjustment by the patient for optimal use.

11 Claims, 3 Drawing Sheets

ORTHOPEDIC THERAPY AND REHABILITATION DEVICE

TECHNICAL FIELD

This invention relates generally to devices for assisting in therapy and rehabilitation of knee, ankle, and hip joints following surgery, and, more specifically, to an improved therapy and rehabilitation device having a flexible wrap-around style boot which substantially fully and securely supports a user's foot and ankle and includes a pair of adjustable manipulation straps and grasping handles to enable a patient to induce assisted and active joint motion in a safe and controlled manner.

BACKGROUND ART

With improving technology and medical procedures, knee, hip, ankle and other orthopedic surgery has been greatly refined in the recent past, and is more widely available and performed more often every year. While surgical procedures and techniques have improved, post operative treatment always includes prevention of unnecessary residual joint stiffness and focuses on achieving maximum functional range of motion as soon as possible. In order to achieve optimal recovery, early assisted and active joint motion is generally encouraged. In the past, physical therapists, physicians, and clinical staff were often required to manually assist recovering patients in therapy movement of reconstructed joints and the like. Additionally, heretofore there has not been available a simple, safe, and reliable apparatus for encouraging and enabling early assisted and active joint motion by the patient. Physical therapists have been known to use bed sheets tied around a patient's foot to induce knee joint motion after surgery. Obviously, this is a time consuming, inefficient, and, at times, unsafe manner of accomplishing prompt rehabilitation of affected joints. As can be imagined, the unreliability of such makeshift therapy equipment tends to add to the cost of health care and discourages patients from continuing therapy on their own to improve their range of motion when not supervised by a professional therapist. Manual movements, as well as use of bed sheets and other previously available devices, can allow for uncontrolled movements, slippage, and the like which, in turn, can cause pain, injury, lack of confidence in the therapy, and less willingness to undertake such therapy.

Follow-up surgical repair work after knee and other joint surgery are considered by some as a surgical complication, and risks associated with such postoperative surgery include anesthetic complications, supracondylar fractures, wound dehiscence, patellar ligament avulsions, and hemaorthosis. While complications cannot be avoided in all instances, it is believed that most such complications occur in cases where assisted and active joint motion therapy was not aggressively undertaken. Consequently, a reliable and simple device which can be used by the patient to facilitate and increase postoperative flexion and range of motion exercise of affected joints is needed and has heretofore been unavailable in the industry.

While a variety of exercising devices directed to use in toning and exercising the legs, feet, ankles and hips have been attempted over the years, none of these devices have serious practical application in the surgical therapy and rehabilitation context. In fact, attempts to use these devices for rehabilitation could seriously impair or reinjure the joint because they are not designed to provide adequate support. For example, exercise devices employing a stirrup wherein both of the patient's feet were held upon a stiff plate, and wherein two elongated handles extended from left and right hand pull connections so that the power of the arms could be utilized in pulling against the power of the legs. Such an arrangement is unwieldy and fails to allow for careful control of movements of a particular joint, support of the limb being worked to prevent slippage, and reliability and safety in use. The stiff foot plate of these devices disperses the force of the pull over the total surface area which does not account for splay in the foot. Many exercise devices do not adequately control flexion so that the joint is strengthened rather than reinjured. In addition, these devices do not prevent torsion which can injure the leg. Some well known exercise devices employ cords or straps for securing the foot holding device to the user's foot which can inflict undue binding force at a localized point which can injure the user at these points of force, and the nonuniform application of force also can reinjure the leg. Most significant in the prior art, is the failure to provide a foot support element which sufficiently supports (or immobilizes) the lower leg to limit reinjury and isolate the appropriate muscles, tendons, etc.

Exercise devices, generally do not produce splay, or widening of the foot which occurs anteriorly during the toe-off phase of gait. It is essential to produce this during rehabilitation because biarticular muscles, which span two joints, are dependent on splay for their exact functions. If splay is not taken into consideration, the recovery will be nonspecific, longer, painful, and more costly. A rehabilitative device which employs a support mechanism that provides splay is needed.

Consequently, while a variety of devices and methods have been devised for exercising various parts of the body, heretofore there has not been available a simple, safe, and reliable orthopedic device for therapy and rehabilitation of a joint which has undergone reconstruction, prosthesis implant, or other orthopedic surgery or the like. There has been no product which provides splay, line of pull without twisting, and anatomically supports the foot as if it were weight bearing. Moreover, there has not been available a device which is conducive to optimum rehabilitation of knee, ankle, and hip joints or the like, and which is safe and simple enough to encourage the patients independent use whether in a hospital or at home, and without requiring professional supervision.

DISCLOSURE OF THE INVENTION

It is an object of this invention to obviate the above described problems and shortcomings of the devices and procedures heretofore available in the assisted and active joint motion therapy and rehabilitation area.

It is also an object of the present invention to provide a simple and reliable therapy and rehabilitation device which can be properly and safely utilized by a patient without professional supervision.

It is yet another object of the present invention to provide an improved, lightweight, and relatively inexpensive device for orthopedic therapy and rehabilitation following surgery.

It is yet another object of the present invention to provide an improved orthopedic device for therapy and rehabilitation of knee, ankle, and hip joints which is simple in operation, easy to put on and take off, and which comfortably conforms to and supports the user's foot and ankle in use.

It is still another object of the present invention to support the superficial and deep transverse metatarsal ligaments of the foot to cause splay or widening of the forefoot during the exercises which simulates the propulsive phase of gait (walking stride) and encompasses the actual complete range of motion for rehabilitating the joint.

It is another object of the present invention to provide an orthopedic device for therapy and rehabilitation of knee joints and the like which includes a flexible wraparound style boot which substantially conforms to and supports the user's ankle and foot without unnecessary binding, and which enables controlled and safe flexion (without twisting or torsion) of an affected joint by the patient in an unsupervised environment.

In accordance with one aspect of the present invention, there is provided an orthopedic device for therapy and rehabilitation of knee joints and the like which includes a flexible wraparound style boot which substantially supports a user's foot and ankle. The boot includes an interior for receiving the user's foot, heel and toe portions, and a substantially open front portion for easy insertion and withdrawal of a user's foot. An adjustable closure spans across the open front portion to help conform the boot to the user's foot without unnecessary binding, and a pair of flexion straps extend from opposite sides of the toe portion of the boot adjacent the substantially open portion. A pair of grasping handles are attached to respective flexion straps to provide convenient exercise control by the patient. In a preferred embodiment, the flexion straps are adjustable in length adjacent the handles to facilitate adjustment by the patient for optimal use.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
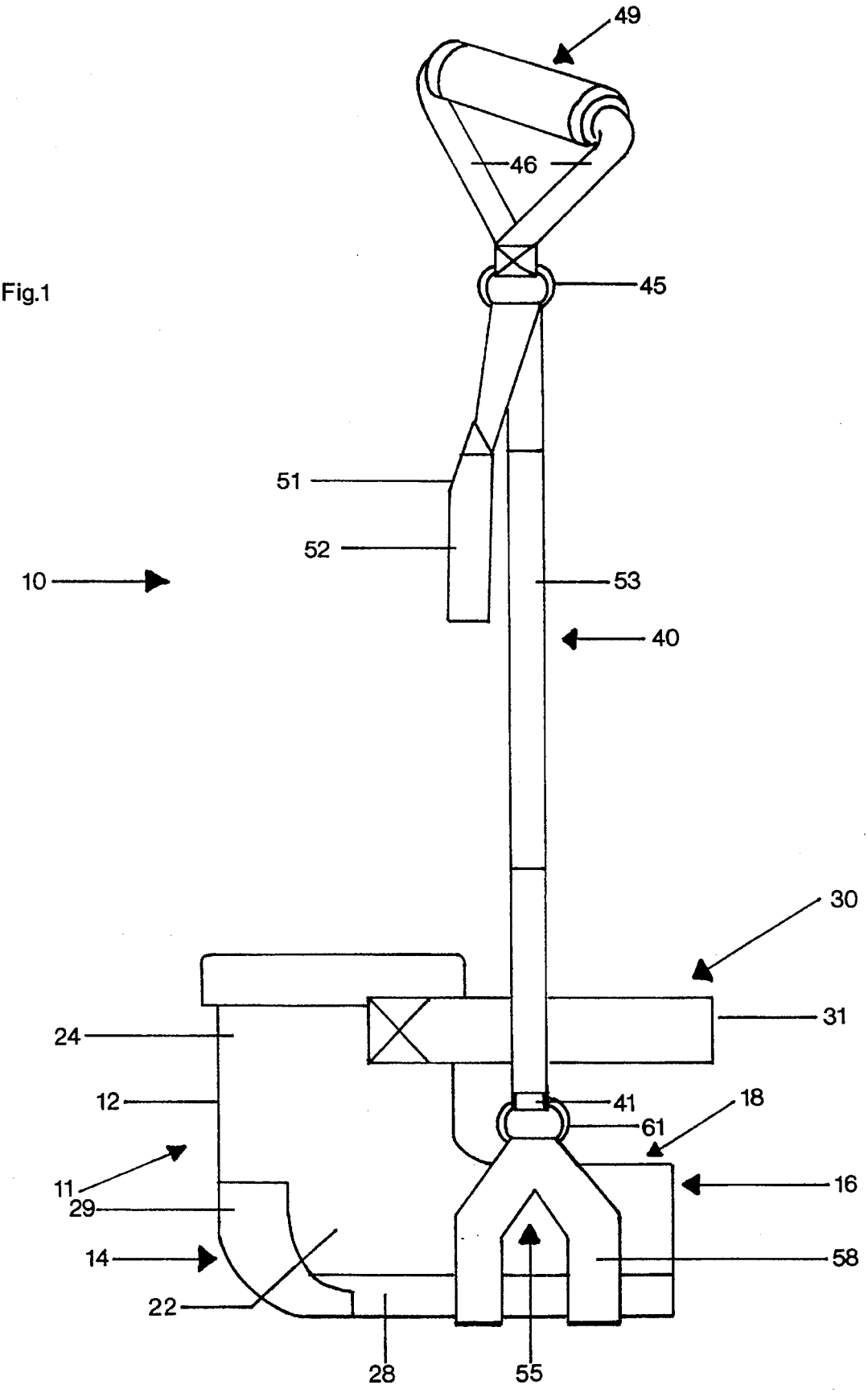
FIG. 1 is a side elevational view of the new orthopedic therapy and rehabilitation device of the present invention.

Referring now to the drawings in detail, wherein like numerals indicate the same elements throughout the views, FIG. 1 illustrates a preferred embodiment of an orthopedic device 10 of the present invention. Orthopedic device 10 comprises a lower leg support element 11 for substantially supporting a user's foot and ankle, and further comprising a flexible wraparound style boot 12 having an interior 20 (FIG. 2) for receiving the user's foot, and heel and toe portions 14 and 16, respectively.

Figure 2:
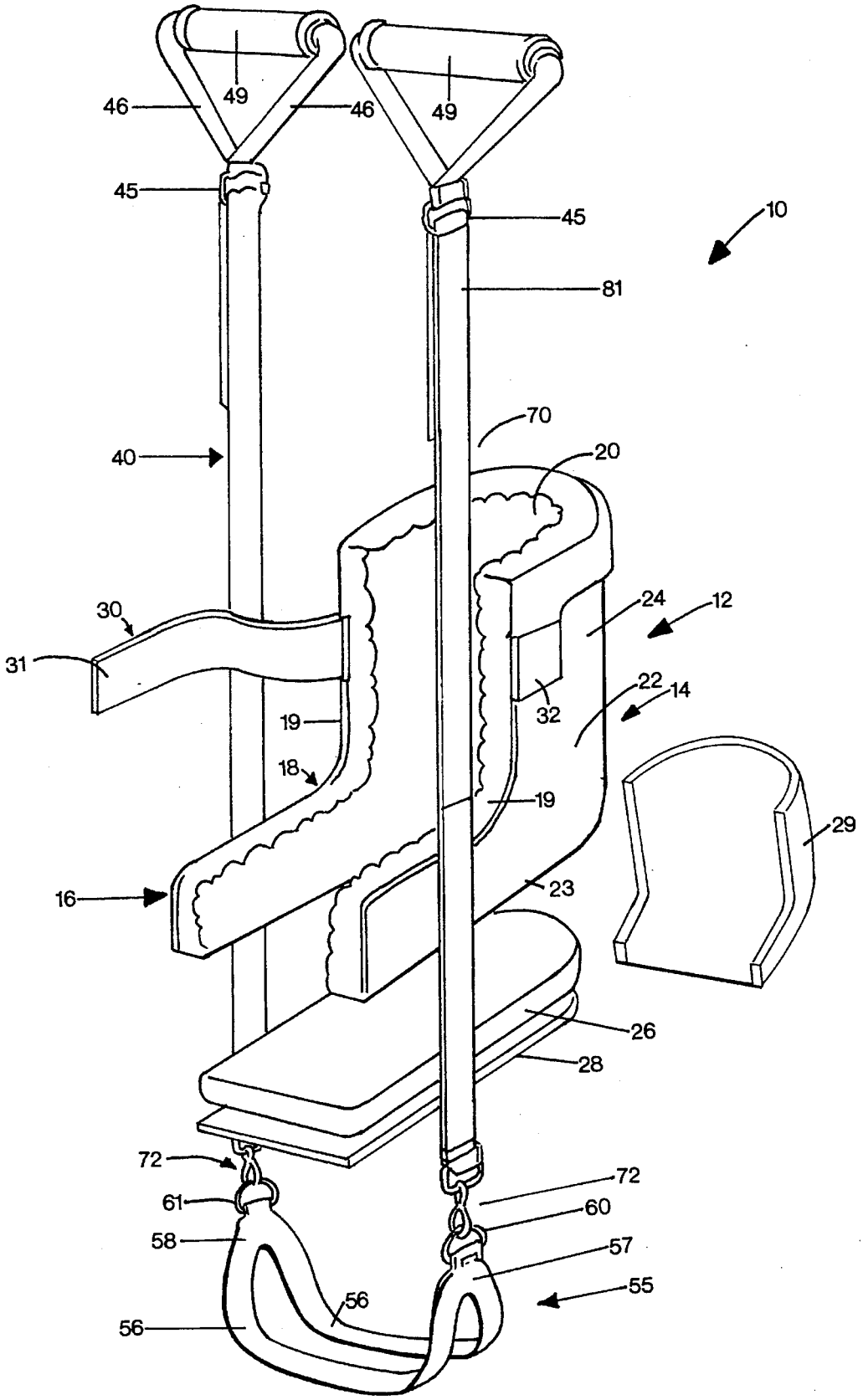
FIG. 2 is a partially exploded perspective view of the orthopedic device of FIG. 1.

As seen in FIGS. 1 and 2, boot 12 can be provided in the form of a unitary structure formed of flexible material such as canvas, cotton, nylon, plastic or a combination of suitable materials as selected by those skilled in the art. As will be described below, boot 12 also can be provided as a plurality of pieces connected together such as by sewing, adhesively joining, heat welding or the like. Boot 12 alternatively might be provided as a integral structure formed from a single piece of flexible material molded in the desired shape or otherwise attached along predetermined seam lines. A multipiece boot 12 is illustrated in FIG. 2 merely as an example of one preferred embodiment. Particularly, boot 12 is provided in the form of a flexible heel portion 14 integrally formed with a flexible toe portion 16, such as from a canvas or blend of cotton and nylon fabric for comfort and strength. Opposing curved front edges 19 define a substantially open portion 18 of boot 12, which provides for easy insertion and withdrawal of a user's foot. An inner sole 26, may comprise fleece 21, terry cloth, or a similar material for comfort and moisture absorption, is sewn to lower edges 23 of boot 12. Optionally, an outer sole 28 is provided to lend additional strength and support to boot 12.

In use, a wearer's foot is inserted through open portion 18, such that the wearer's heel fits against the lower heel 22 and sole 26, while the ankle support 24 of boot 12 extends upwardly in a longitudinal direction to closely conform to the wearer's ankle and lower leg portions. The foot support provided by this device structurally supports the anatomy of the foot during extreme range of motion of the knee by supporting the superficial and deep transverse metatarsal ligaments of the foot which causes splay or widening of the forefoot during range of motion exercises which simulates (although non-weight bearing) the propulsive phase of gait. Following insertion of the wearer's foot, one or more adjustable closures 30 can be used to connect the opposite open edges of boot 12, such as by a hook and loop fastener arrangement. Particularly, flexible strap 31 is shown as including hook structures for inner action and locking with the loop patch 32. Several adjustable closures 30, rather than a single closure 30 as shown, may be preferred to allow boot 12 to closely conform to and support the wearer's foot and ankle as appropriate.

A flexion strap bridle 55 having opposite ends 57 and 58 preferably circumscribes the outer periphery of toe portion 16 (and preferably about the exterior of boot 12 itself). Opposite ends 57 and 58 are secured to attachment elements such as O-ring supports 60 and 61, respectively. A pair of spaced foot support straps 56 connects ends 57 and 58, and preferably, are sewn or otherwise attached about the outer periphery of the open toe portion 16 of boot 12. As most clearly shown in FIG. 1, it is further preferred that bridle 55 is sewn or otherwise attached to boot 12 such that the bridle 55 substantially wraps around toe portion 16. This arrangement enhances the support afforded to the user's foot during flexion and exercise therapy, and the independent attachment of bridle 55 about the periphery of boot 12 provides this support comfortably and without undue binding of toe portion 16 about the wearer's foot, because the force exerted by the bridle 55 is spread throughout the boot and not localized at the toe portion 16. Additionally, it is preferable that manipulation straps 40 and 70 attach to bridle 55 at locations spaced outwardly from the open front edge 19 to insure that longitudinal force imposed by the straps will not tend to open boot 12 along edge 19.

The pair of flexion straps 40 and 70 preferably are substantially inextensible and extend outwardly and away from boot 12. Particularly, the lower end of strap 40 is illustrated in FIG. 1 as being attached to O-ring support 61. It is contemplated that O-ring supports 60 and 61 can be provided in the form of a relatively rigid and strong ring formed of stainless steel, plastic, or the like. While it is contemplated that straps 40 and 70 preferably will be permanently connected to O-ring supports 60 and 61 (such as by looping the strap through the ring and stitching or riveting it to itself), a detachable connection, such as a spring loaded clip or buckle (e.g., quick release buckle 72 illustrated in FIG. 2), could also be provided to enable selected removal of the straps. Removal of such straps might be desired to enable replacement of boot 12 with a new or clean boot, a boot having a different liner (e.g., a fleece liner as opposed to a terry cloth liner, or no liner at all), or to substitute a different size boot as desired.

As illustrated with respect to flexion strap 40, upper ends of straps 40 and 70 preferably are each adjustably connected to a pair of diverging handle straps 46 which detachably connects to a grasping handle 49. One example of suitable attaching elements includes a pair of D-rings 45 through which the strap is extended and then folded back over one of the D-rings and under the other D-ring to provide a relatively common self-tightening adjustable cinch arrangement. Excess strap length 51 may include securing elements 52 (such as hook and loop material, buttons, snaps or the like) for securing the excess length 51 to strap 40 such that the excess length 51 does not get in the way and to maintain the straps at a desired length. Although it is not necessary, grasping handle 49 preferably includes a grip made of foam or other appropriate material to facilitate comfortable and reliable grasping by the patient.

Figure 3:
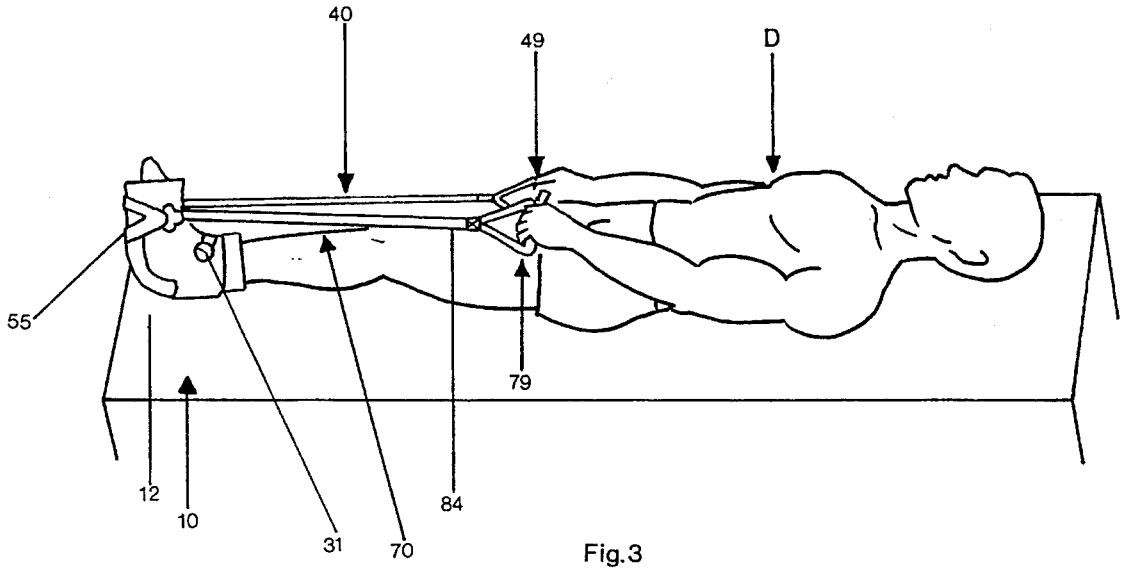
FIG. 3 is an elevational view of an orthopedic device of the present invention in use, showing the flexible boot fit onto the foot and ankle of the user.
Figure 4:
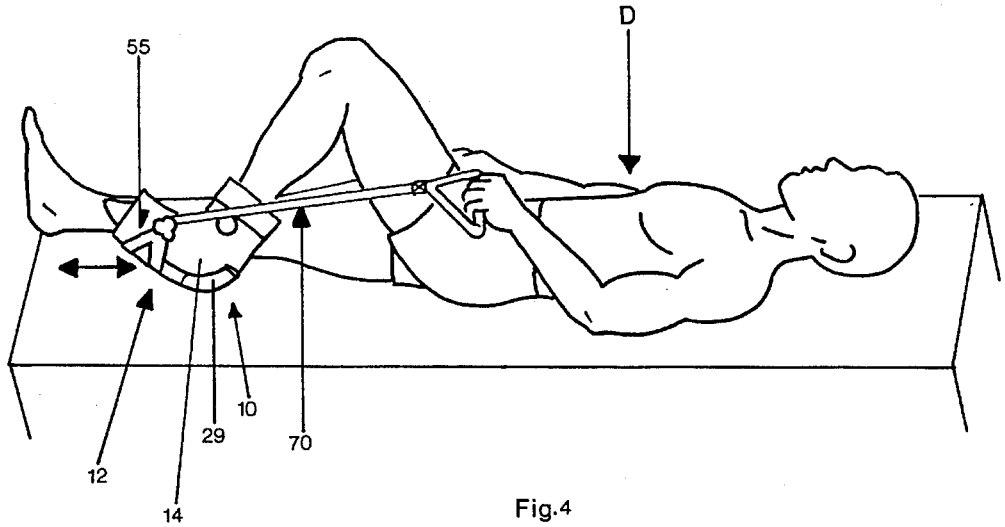
FIG. 4 is an elevational view similar to FIG. 3, illustrating flexion and exercise of a knee joint by a patient utilizing an orthopedic therapy and rehabilitation device of the present invention.

FIGS. 3 and 4 illustrate use of orthopedic device 10 by patient P, where patient P is in a supine position. FIG. 3 illustrates device 10 in use on the patient's P left foot and ankle. Boot 12 and closure 31, which is secured across the open front portion, substantially enclose and support the left foot and ankle such that boot 12 conforms snuggly about the foot and ankle. Right and left flexion straps 40 and 70, respectively, are adjusted such that grasping handles 49 and 79 are conveniently accessible to the patient's hands. It is preferred that the manipulation straps be adjusted so that the patient can reach grasping handles 49 and 79 with the affected leg and arms in fully extended position, as illustrated in FIG. 3. Once manipulation straps 40 and 70 are properly adjusted in length, their distal ends (51 and 81) are preferably secured along the length of the respective straps, such as by the hook and loop arrangement mentioned above. The manipulation straps 40 and 70 allow the user to apply force in a line of pull that is functionally correct without harmful torsion or twisting of the leg.

Once boot 12 is substantially snugly conformed to the patient's foot and ankle, and flexion straps 40 and 70 are properly adjusted for length, the patient is instructed to begin flexion of the knee joint by sliding the booted heel (without assistance from the flexion straps) in an upward direction toward the buttocks. When the patient achieves full unassisted flexion, the flexion straps 40 and 70 are utilized to gently flex the joint beyond that point. When the maximum amount of flexion has been reached with the assistance of the flexion straps, the patient is instructed to maintain that flexion for a predetermined amount of time (e.g., 30 seconds). After holding the flexed position for the required period of time, the leg is allowed to relax into its fully extended position without mechanical assistance.

FIG. 4 illustrates the use of manipulation straps 40 and 70 to assist in the flexion of the patient's left knee joint, as described above. As additional range of motion is gained, likewise the maximum amount of flexion will increase. Of course, the actual workout program for any particular patient should be prescribed by a physician or therapy specialist, and may be varied accordingly. As can be appreciated, however, the strap bridle 55 extends about the periphery of boot 12 adjacent toe portion 16, providing connection points for flexion straps 40 and 70 in alignment with opposite sides of the user's foot without causing undue binding effects on the foot. Additionally, bridle 55 underlies the user's foot and provides additional support in conjunction with boot 12. It may also be preferred to provide the bottom surface of outer sole 28 and the rear exterior of heel portion 14 with a slide and/or wear surface (e.g., as shown at 29) to facilitate and withstand repeated sliding motion of the user's heel along a surface (e.g., table, floor or bed) on which the user is lying. Slide surface 29 might be provided in the form of a slick coating of wear resistant plastic, nylon material, or the like.

The orthopedic device 10 of the subject invention has shown that it is indeed simple in construction, easy to use, lightweight, relatively inexpensive, and conforms securely to each individual user automatically. The device has successfully helped relieve patients from unnecessary pain as a result of increased joint motion, encourages the patient to continue exercises without professional assistance following surgery to maintain and/or increase the range of motion, and provides more flexion and stretch of targeted muscle groups and joints in a safe and controlled manner.

The individual and separate nature of flexion straps 40 and 70, and their associated grasping handles 49 and 79, respectively, affords the patient relatively close control over flexion and exercise of targeted joints or muscles. For example, by increasing the distance between the grasping handles, an increase in the relative lateral control of movement can be obtained. Conversely, the speed and distance of longitudinal movement can be carefully controlled as well.

By allowing the patient to exercise in the supine position, the flexor and extensor muscles can remain more relaxed, thereby facilitating greater stretch and range of motion for joint movements. Because the patient gains a sense of control over his own rehabilitation and therapy, the confidence level is increased and accomplishment of expedited rehabilitation is facilitated without the requirement of constant involvement or supervision of health care professionals. The present orthopedic device thereby assists in both passive and active range of motion exercises, minimizing the potential for soft tissue pain, muscle spasms and general tightness which often accompany immobilized joints.

Having shown and described the preferred embodiments of the present invention, further adaptations of the orthopedic device for therapy and rehabilitation of knee joints and the like can be accomplished by appropriate modifications by one of ordinary skill in the art without departing from the scope of the present invention. Several of these potential modifications have been mentioned and others will be apparent to those skilled in the art. Accordingly, the scope of the present invention should be considered in terms of the following claims and is understood not to be limited to the details of structure and operation shown and described in the specification and drawings.

We claim:

1. An orthopedic device for therapy and rehabilitation of ankle, knee and hip joints to increase the range of motion, said device comprising:

a foot support element for substantially supporting a user's foot and ankle, comprising a flexible wraparound style boot having an interior for receiving a user's foot, a bottom outside portion, and heel and toe portions, a foot axis defined between said heel and toe portions, and a substantially open front portion for easy insertion and withdrawal of a user's foot:

a pair of flexible support straps attached to said foot support element adjacent the toe portion, said support straps are configured to be spaced along the foot axis as the straps extend around said bottom outside portion and joined together at each end adjacent said substantially open front portion wherein said support straps support the bottom of the foot and cause biomechanical splaying of the forefoot;

at least one adjustable closure which spans across said open front portion to help conform said boot to the user's foot and ankle;

a pair of substantially inextensible flexion straps having one end attached to said pairs of support straps adjacent said toe portion on opposite sides of said substantially open front portion and extending outwardly away from said boot to provide a straight line of pull with minimal torque injured joint: and a pair of grasping handles each attached to a free end of respective flexion straps.

2. The orthopedic device of claim 1, said flexion straps include means for adjusting length utilizing hook and loop fastener arrangement to effectively adjust the position of the grasping handles relative to said boot.

3. The orthopedic device of claim 1, wherein said boot comprises a unitary piece of flexible material in the form of an open envelope.

4. The orthopedic device of claim 1, wherein said heel portion of said boot extends upwardly adapted to substantially enclose a user's ankle in use.

5. The orthopedic device of claim 1, further comprising attaching means for selectively adjusting the length of said flexion straps between said boot and the respective grasping handle, said attaching means located adjacent said grasping handle.

6. The orthopedic device of claim 1, further comprising a bridle strap having opposite ends and being attached adjacent said toe portion of said boot said bridle strap extending around the periphery of said interior and having attachment elements located adjacent said opposite ends for securing said pair of flexion straps on opposite sides of said open portion of said boot to reduce amount of torque during rehabilitation.

7. The orthopedic device of claim 1, wherein said flexion straps have means for selectively detaching from said boot.

8. The orthopedic device of claim 1, wherein said adjustable closure comprises a quick release hook and loop arrangement.

9. The orthopedic device of claim 1, wherein said boot further comprises an inner fleece surface having means for comfortably interfacing with a user's foot inserted therein.

10. The orthopedic device of claim 1, further comprising outer slide surface adjacent said heel portion of said boot.

11. The orthopedic device of claim 1, further comprising securing elements for securing the excess length of each flexion strap.

* * * * *